US006497296B1

(12) United States Patent
McGriff et al.

(10) Patent No.: US 6,497,296 B1
(45) Date of Patent: Dec. 24, 2002

(54) ANCHORING SYSTEM FOR A DIRECTIONAL DRILLING MACHINE AND METHODS OF USE

(75) Inventors: Michael Lee McGriff, New Sharon, IA (US); Brian John Bischel, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/587,199

(22) Filed: Jun. 5, 2000

(51) Int. Cl.[7] ..... E21B 7/04
(52) U.S. Cl. ..... 175/62; 175/162; 175/203
(58) Field of Search ..... 175/53, 61, 62, 175/85, 113, 118, 162, 203; 405/148; 173/188; 52/155, 157, 158, 159, 160, 161

(56) References Cited

U.S. PATENT DOCUMENTS

| | | | | |
|---|---|---|---|---|
| 4,202,416 A | | 5/1980 | Blaschke et al. | |
| 4,585,080 A | | 4/1986 | Bender | |
| 4,843,785 A | | 7/1989 | Sero et al. | |
| 4,953,638 A | | 9/1990 | Dunn | |
| 5,303,783 A | * | 4/1994 | Begnaud et al. | 175/53 |
| 5,555,947 A | | 9/1996 | Bunker et al. | |
| 5,570,975 A | | 11/1996 | Reinert, Sr. | |
| 5,709,276 A | | 1/1998 | Lee | |
| 5,711,384 A | | 1/1998 | Jenne | |
| 5,794,724 A | * | 8/1998 | Moller | 175/170 |
| 5,941,322 A | | 8/1999 | Stephenson et al. | |
| 6,003,598 A | * | 12/1999 | Andreychuk | 166/76.1 |
| 6,109,371 A | * | 8/2000 | Kinnan | 175/61 |
| 6,216,803 B1 | * | 4/2001 | Deken | 175/162 |

FOREIGN PATENT DOCUMENTS

SU 1484894 6/1989

OTHER PUBLICATIONS

Brochure, "bor–mor®", *The All New 1500TX Self–Contained Directional Drilling System*, 2 pgs. (Undated).*
Brochure, "bor–mor®", *Self–Contained Directional Drilling Equipment Model 400TX*, 4 pgs. (Undated).*
Brochure, "Straightline Manufacturing Inc.", *DirectLine DL1810*, 2 pgs. (Undated).*

(List continued on next page.)

*Primary Examiner*—David Bagnell
*Assistant Examiner*—Jennifer R. Dougherty
(74) *Attorney, Agent, or Firm*—Merchant & Gould P.C.

(57) ABSTRACT

A horizontal directional drilling machine for generating a bore with a drill string. The machine includes a frame defining a thrust axis. A rotational drive head for rotating the drill string is mounted on the frame. A thrust mechanism is provided for moving the rotational drive head in a first direction along the thrust axis to push the drill string into the ground, and a second direction along the thrust axis to pull the drill string from the ground. The horizontal directional drilling machine also includes an anchoring arrangement connected to the frame. In one embodiment, the anchoring arrangement includes a stake-down unit that is pivotally movable about a pivot axis that is generally transversely oriented relative to the thrust axis. The stake-down unit includes a power auger, and a stake-down actuator for moving the power auger toward and away from the ground. The anchoring arrangement also includes a tilt actuator for pivoting the stake-down unit about the pivot axis. In another embodiment, the anchoring arrangement can include a stake-down unit as described above that is laterally adjustable relative to the thrust axis.

23 Claims, 8 Drawing Sheets

OTHER PUBLICATIONS

Brochure, "Straightline Manufacturing Inc.", *DirectLine Extended–Range Directional Borign System*, 4 pgs. (Undated).*
Brochure, "Horizontal Directional Drills", 1 pg. (Undated).*
Brochure, "Worthington", *Meet the Rock Master*, 16 pgs. (Oct. 1934).
Brochure, "Vermeer", *Atlas Bore Planner*, 4 pgs. (1999).
Brochure, "Vermeer" *Horizontal Directional Drilling Fluid–Mixing Systems*, 4 pgs. (1999).
Brochure, "Vermeer", *Navigator D7x11A Directional Boring System*, 4 pgs. (1999).
Brochure, "Vermeer", *Navigator D10x15 Directional Boring System*, 6 pgs. (1998).
Brochure, "Vermeer", *Navigator D16x20A Directional Boring System*, 6 pgs. (1999).
Brochure, "Vermeer", *Navigator D24x26 Directional Boring System*, 4 pgs. (1998).
Brochure, "Vermeer", *Navigator D24x40A Directional Boring System*, 4 pgs. (1998).
Brochure, "Vermeer", *Navigator D40x40 Directional Boring System*, 6 pgs. (1998).
Brochure, "Vermeer", *Navigator D50x100A Directional Boring System*, 4 pgs. (1999).
Brochure, "Vermeer", *Navigator D80x100A Directional Boring System*, 6 pgs. (1999).
Brochure, "Vermeer", *Navigator Underground Horizontal Directional Drilling*, 4 pgs. (1999).
Brochure, "Vermeer", *Underground Equipment*, 6 pgs. (1999).
Brochure, "Vermeer", *Underground Equipment*, 20 pgs. (1997).
Press Release, "Straightline", *Introducing 2462 Directional Drill with Power Anchor*, 1 pg. (Jan. 1999).

* cited by examiner

ANCHORING SYSTEM FOR A DIRECTIONAL DRILLING MACHINE AND METHODS OF USE

FIELD OF THE INVENTION

The present invention relates generally to underground drilling machines. More particularly, the present invention relates to systems or methods for anchoring underground drilling machines for use in horizontal directional drilling.

BACKGROUND OF THE INVENTION

Utility lines for water, electricity, gas, telephone and cable television are often run underground for reasons of safety and aesthetics. Sometimes, the underground utilities can be buried in a trench that is then back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. During drilling, drilling fluid can be pumped through the drill string, over a drill head (e.g., a cutting or boring tool) at the end of the drill string, and back up through the hole to remove cuttings and dirt. After the drill head reaches a desired depth, the drill head is then directed along a substantially horizontal path to create a horizontal hole. After the desired length of hole has been drilled, the drill head is then directed upwards to break through the ground surface. A reamer is then attached to the drill string which is pulled back through the hole, thus reaming out the hole to a larger diameter. It is common to attach a utility line or other conduit to the drill string so that it is dragged through the hole along with the reamer.

During drilling and pull-back operations, substantial forces are applied to the drill string. Thus, during directional drilling operations, it is important for a directional drilling machine to be "anchored" or "staked-down" to prevent the directional drilling machine from moving during drilling or pull-back sequences.

SUMMARY OF THE INVENTION

One aspect of the present invention relates to a horizontal directional drilling machine for generating a bore with a drill string. The machine includes a frame defining a thrust axis. A rotational drive head for rotating the drill string is mounted on the frame. A thrust mechanism is provided for moving the rotational drive head in a first direction along the thrust axis to push the drill string into the ground, and a second direction along the thrust axis to pull the drill string from the ground. The horizontal directional drilling machine also includes an anchoring arrangement connected to the frame. In one embodiment, the anchoring arrangement includes a stake-down unit that is pivotally movable about a pivot axis that is generally transversely oriented relative to the thrust axis. The stake-down unit includes a power auger, and a stake-down actuator for moving the power auger toward and away from the ground. The anchoring arrangement also includes a tilt actuator for pivoting the stake-down unit about the pivot axis. In another embodiment, the anchoring arrangement can include a stake-down unit as described above that is laterally adjustable relative to the thrust axis.

Another aspect of the present invention relates to an anchoring assembly for a directional drilling machine. The anchoring assembly includes a stake-down mount adapted to be pivotally connected to the directional drilling machine. The anchoring assembly also includes a first and second stake-down units connected to the stake-down mount. Each of the stake-down units includes a power auger and a stake-down actuator. The first stake-down unit is connected to the stake-down mount by a lateral extension member that is mounted to slide relative to the stake-down mount.

A further aspect of the present invention relates to a method for anchoring a horizontal directional drilling machine including a frame having a thrust axis. The method includes aligning the thrust axis at an oblique angle relative to the ground; pivoting a power auger of the directional drilling machine about a tilt axis generally transversely aligned relative to the thrust axis; and driving the pivoted power auger into the ground.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF OF THE DESCRIPTION DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawing figures in which identical elements are numbered identically throughout, a description of various exemplary aspects of the present invention will now be provided.

I. Description of a Representative Horizontal Directional Drilling Machine

Figure 1:
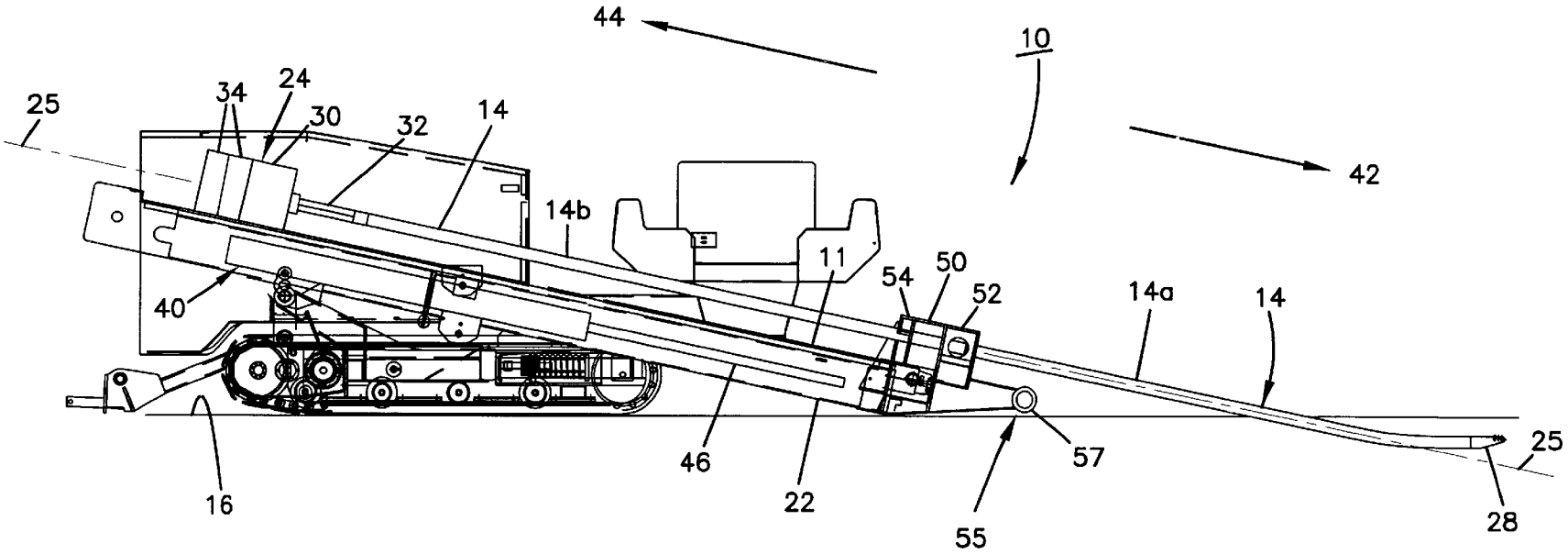
FIG. 1 shows a horizontal directional drilling machine adapted for use with an anchoring system constructed in accordance with the principles of the present invention.

FIG. 1 illustrates a directional drilling machine 10 constructed in accordance with the principles of the present invention. The drilling machine 10 is adapted for pushing a drill string 14 into the ground 16, and for pulling the drill string 14 from the ground 16. The drill string 14 includes a plurality of elongated members 14*a* and 14*b* (e.g., rods, pipes, etc.) that are connected in an end-to-end relationship. A drill head 28 is preferably mounted at the far end of the drill string 14 to facilitate driving the drill string 14 into the ground 16. The dill head 28 can include, for example, a cutting bit assembly, a starter rod, a fluid hammer, a sonde holder, as well as other components. Preferably, each of the elongated members 14*a* and 14*b* includes a threaded male end 18 (shown in FIG. 2) positioned opposite from a threaded female end (shown in FIG. 2). To couple the elongated members 14*a* and 14*b* together, the male end 18 of the elongated members 14*a* is threaded into the female end 20 of the elongated member 14*b* to provide a threaded coupling or joint.

Referring back to FIG. 1, the directional drilling machine 10 includes a frame 11 including an elongated guide or track 22 that can be positioned by an operator at any number of different oblique angles relative to the ground 16. A rotational driver 24 is mounted on the track 22. The rotational driver 24 is adapted for rotating the drill string 14 in forward and reverse directions about a longitudinal axis of the drill string 14.

As shown in FIG. 1, the rotational driver 24 includes a gear box 30 having an output shaft 32 (i.e., a drive chuck or a drive shaft). The gear box 30 is powered by one or more hydraulic motors 34. As depicted in FIG. 1, two hydraulic motors 34 are provided. However, it will be appreciated that more or fewer motors 34 can be coupled to the gear box 30 depending upon the amount of torque that is desired to be generated by the rotational driver 24. While a hydraulic system has been shown, it will be appreciated that any number of different types of devices known for generating torque could be utilized. For example, in alternative embodiments, an engine such as an internal combustion engine could be used to provide torque to the drill string 14.

The rotational driver 24 is adapted to slide longitudinally up and down the track 22 along a thrust axis 25 (an axis co-extensive with the path of travel of the driver 24). For example, the rotational driver 24 can be mounted on a carriage (not shown) that slidably rides on rails (not shown) of the track 22 as shown in U.S. Pat. No. 5,941,320 that is hereby incorporated by reference. A thrust mechanism 40 is provided for propelling the rotational driver 24 along the track 22. For example, the thrust mechanism 40 moves the rotational driver 24 in a downward direction (indicated by arrow 42) to push the drill string 14 into the ground 16. By contrast, the thrust mechanism propels the rotational driver 24 in an upward direction (indicated by arrow 44) to remove the drill string 14 from the ground 16. It will be appreciated that the thrust mechanism 40 can have any number of known configurations. As shown in FIG. 1, the thrust mechanism 40 includes a hydraulic cylinder 46 that extends along the track 22. The hydraulic cylinder 46 is coupled to the rotational driver 24 by a chain drive assembly (not shown). Preferably, the chain drive assembly includes a chain that is entrained around pulleys or gears in a block and tackle arrangement such that an incremental stroke of the hydraulic cylinder 46 results in an increased displacement of the rotational driver 24. For example, in one particular embodiment, the chain drive assembly displaces the rotational driver 24 a distance equal to about twice the stroke length of the hydraulic cylinder 46. Directional drilling machines having a chain drive arrangement as described above are well known in the art. For example, such chain drive arrangements are used on numerous directional drilling machines manufactured by Vermeer Manufacturing Company of Pella, Iowa.

While one particular thrust arrangement for moving the rotational driver 24 has been described above, the present invention contemplates that any number of different configurations can be used. For example, one or more hydraulic cylinders can be coupled directly to the rotational driver 24. Alternatively, a rack and pinion arrangement could also be used to move the rotational driver 24. Furthermore, a combustion engine or simple chain or belt drive arrangements, which do not use hydraulic cylinders, could also be used.

Referring still to FIG. 1, the drilling machine 10 further includes upper and lower gripping units 50 and 52 for use in coupling and uncoupling the elongated members 14*a* and 14*b* of the drill string 14. The upper gripping unit 50 includes a drive mechanism 54 (e.g., a hydraulic cylinder) for rotating the upper gripping unit 50 about the longitudinal axis 26 of the drill string 14. The gripping units 50 and 52 can include any number of configurations adapted for selectively preventing rotation of gripped ones of the elongated members 14*a* and 14*b*. For example, the gripping units 50 and 52 can be configured as vice grips that when closed grip the drill string 14 with sufficient force to prevent the drill string 14 from being rotated by the rotational driver 24. Alternatively, the gripping units 50 and 52 can include wrenches that selectively engage flats provided on the elongated members 14*a* and 14*b* to prevent the elongated members from rotating.

Still referring to FIG. 1, the frame 11 of the drilling machine 10 also includes an anchoring system mounting location 55. The mounting location 55 is preferably located at a lower end of the track 22. As shown in FIG. 1, the mounting location 55 includes an opening 57 for use in pivotally securing an anchoring system to the frame 11.

II. Description of Representative Anchoring System

Figure 2:
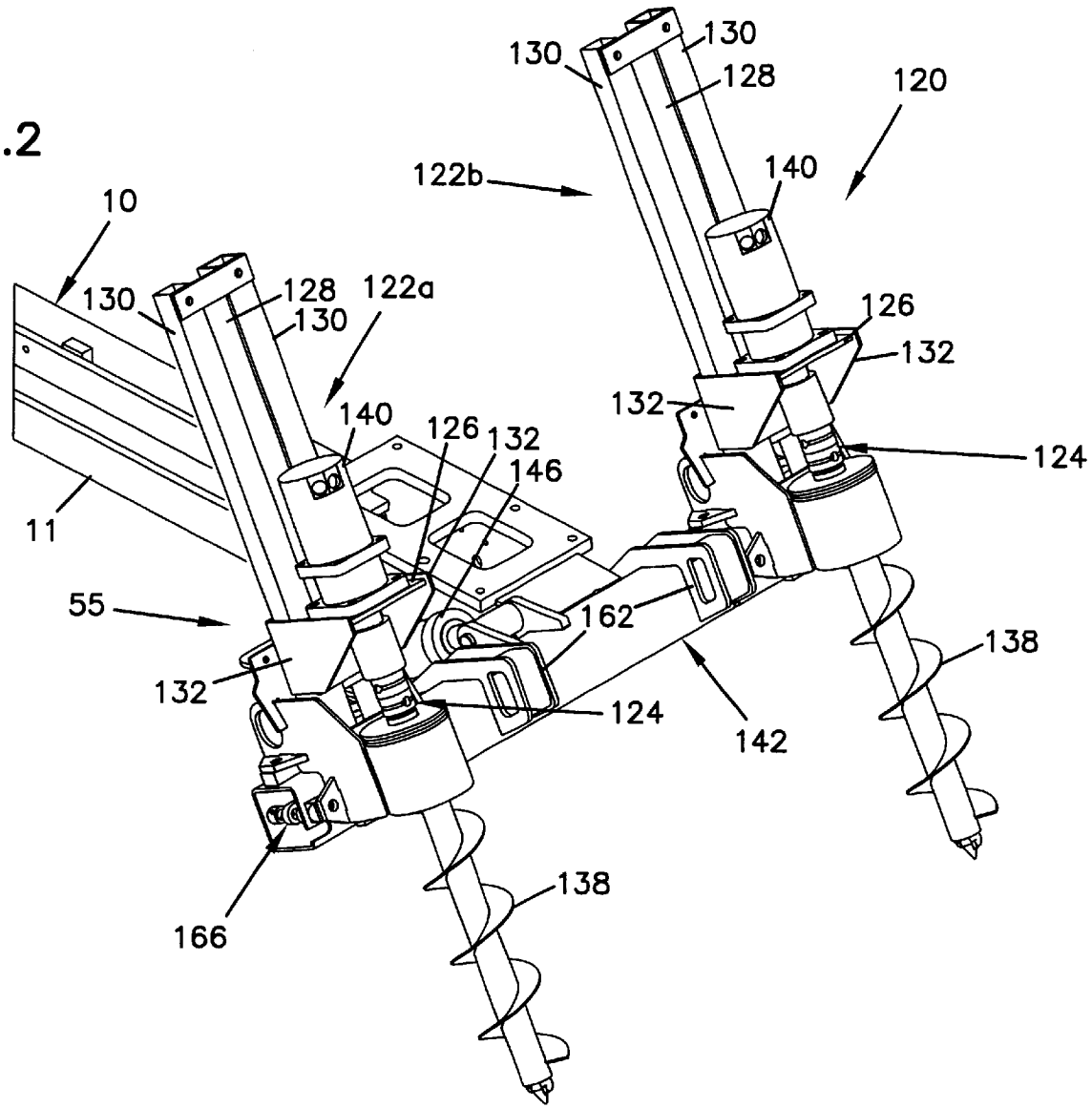
FIG. 2 is a perspective view of an anchoring system constructed in accordance with the principles of the present invention, the anchoring system is shown in a laterally retracted orientation.
Figure 3:
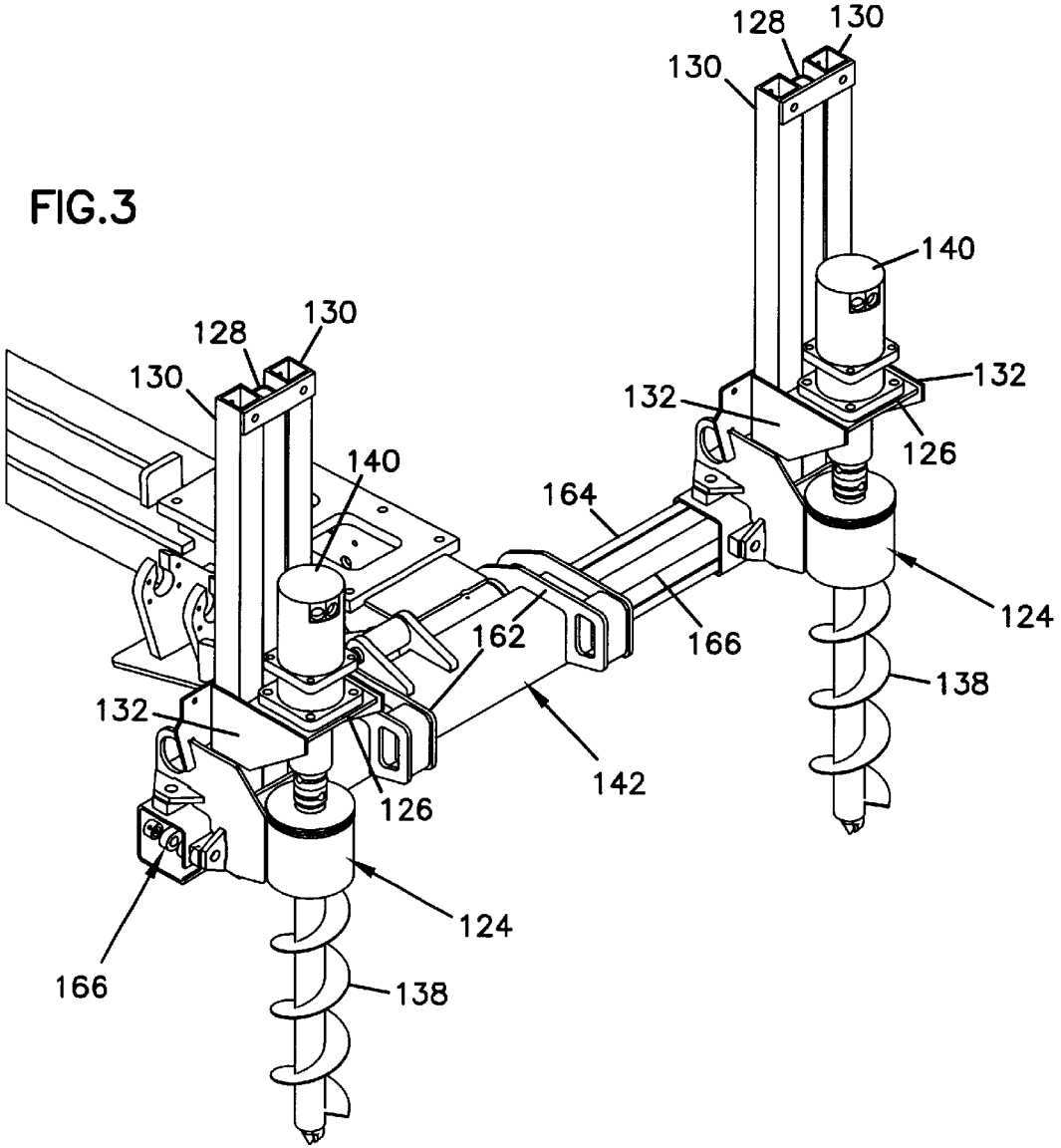
FIG. 3 is a perspective view of the anchoring system of FIG. 2 with the anchoring system in a laterally extended orientation.

FIGS. 2 and 3 illustrate an anchoring system 120 constructed in accordance with the principles of the present invention. The anchoring system 120 is shown mounted at the mounting location 55 of the directional drilling machine 10. For clarity, only the lower end of the drilling machine frame 11 has been shown.

Figure 7:
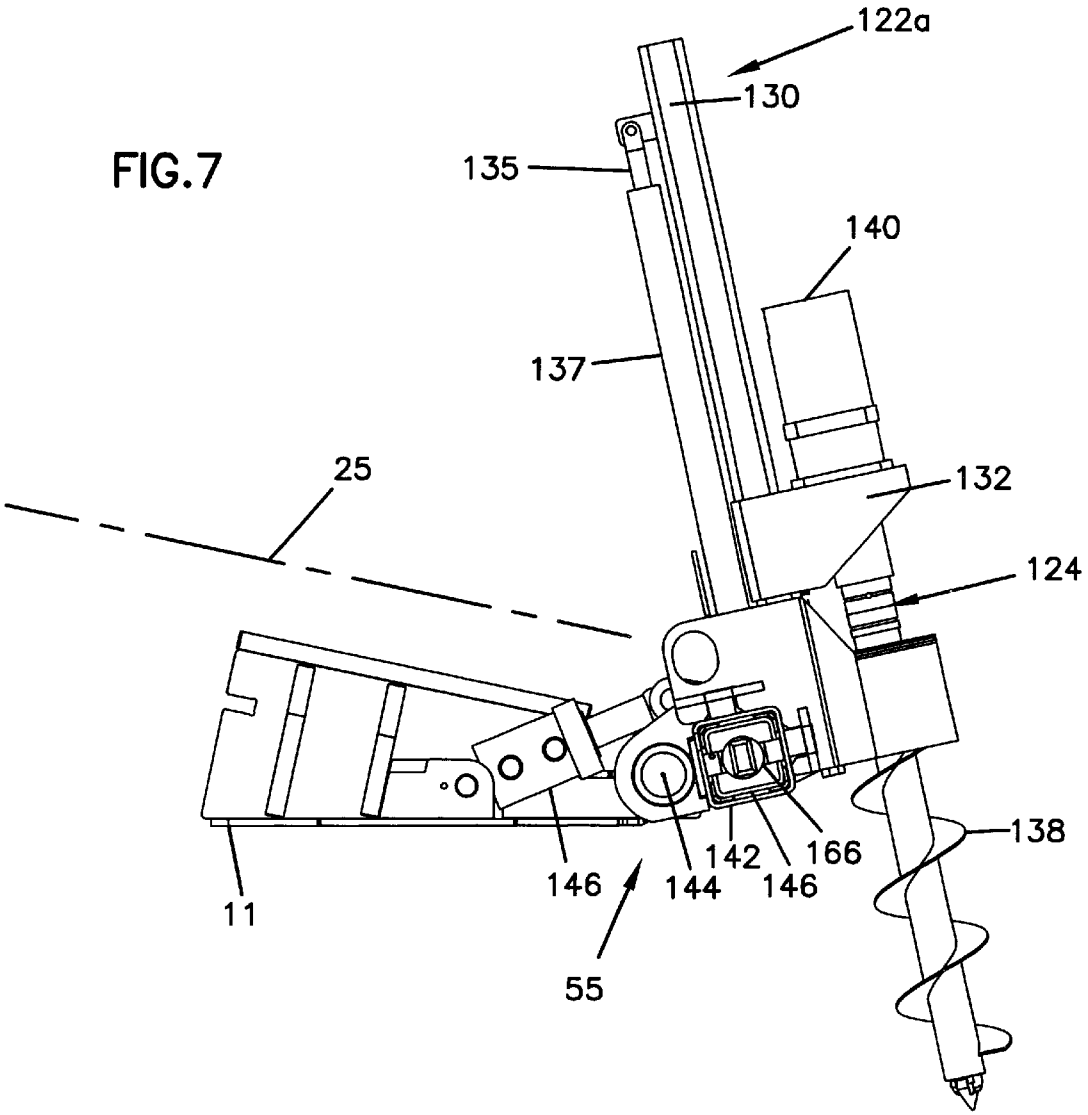
FIG. 7 is a side view showing the anchoring system of FIGS. 2 and 3 in a backwardly tilted orientation.
Figure 8:
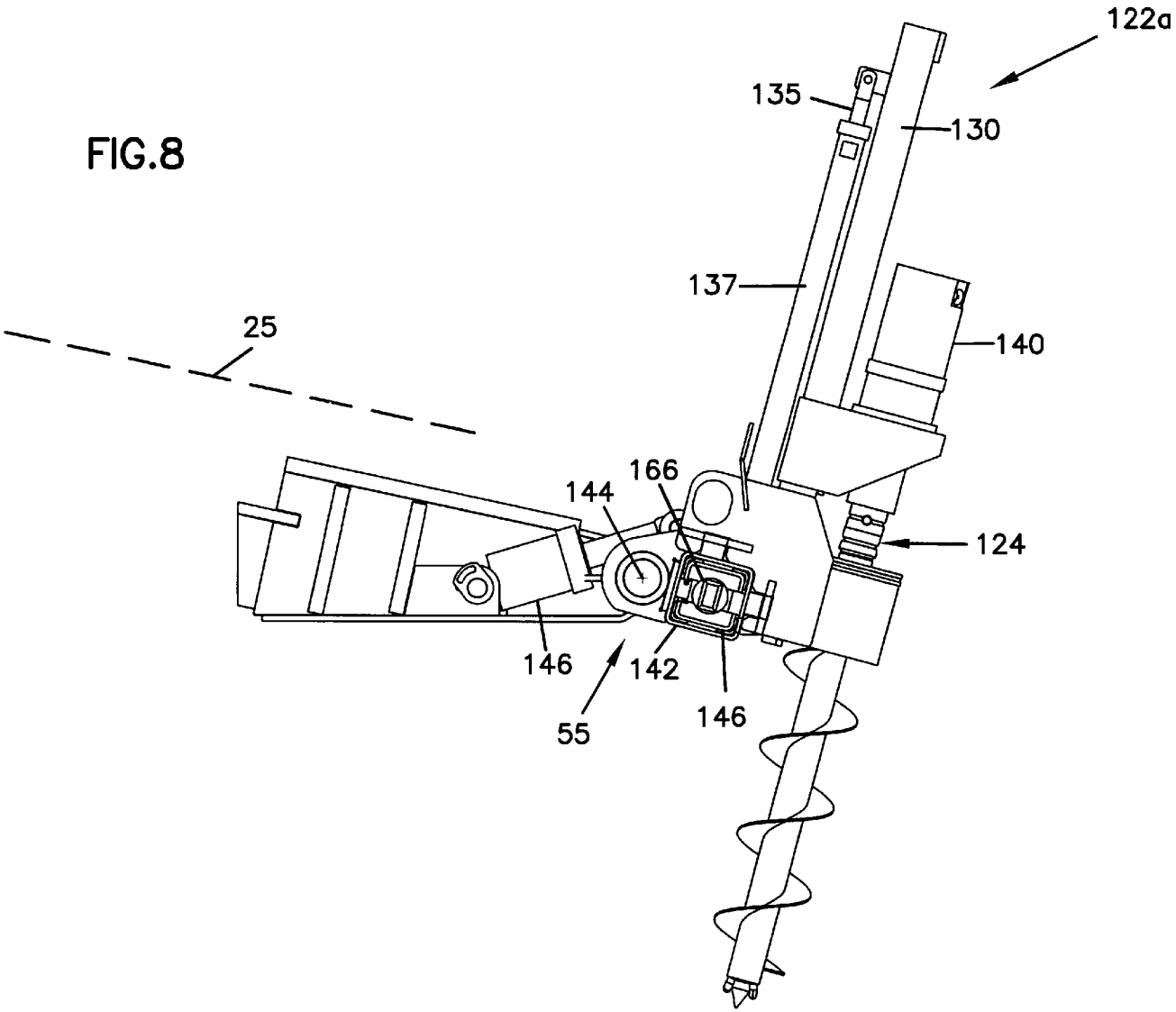
FIG. 8 shows the anchoring system of FIGS. 2 and 3 in a forwardly tilted orientation.

The anchoring system 120 includes two stake-down units 122*a* and 122*b* that preferably each have the same configuration. Each of the stake-down units 122*a* and 122*b* includes a power auger 124 adapted for anchoring the directional drilling machine 10 to the ground. The stake-down units 122*a* and 122*b* are supported by a stake-down mount 142. The stake-down mount 142 is pivotally connected to the frame 11 at a tilt axis 144 (best shown at FIGS. 4, 7 and 8). The tilt axis 144 is transversely oriented relative to the thrust axis 25 of the frame 11. A tilt actuator 146 (e.g., a hydraulic motor, a pneumatic motor, an internal combustion engine, a gear mechanism, etc.) is provided for pivoting the stake-down mount 142 about the tilt axis 144.

By pivoting the stake-down mount 142 about the tilt axis 144, the stake-down units 122*a* and 122*b* can be tilted to different angles relative to the ground. For example, FIGS. 2, 3, 7 and 8 show the anchoring system 120 pivoted to different positions about the tilt axis 144. By pivoting the stake-down mount 142 about the tilt axis 144, an operator can position the stake-down units 122*a* and 122*b* in a particular angular orientation adapted for best stabilizing the directional drilling machine 10. For example, an operator may prefer different angular orientations during pullback sequences as compared to during drilling sequences. Also, operators may prefer certain angular orientations when boring through different types of soil types. Further, the stake-down units 122*a* and 122*b* can also be pivoted to avoid obstruction such as rocks that may be located beneath the stake-down units 122*a* and 122*b*.

The power augers 124 each include an auger 138 and a drive mechanism 140 (e.g., hydraulic motor, a pneumatic motor, combustion engine, etc.) for rotating the auger 138 in forward (i.e., clockwise) and reverse (i.e., counterclockwise) directions. The term "auger" is intended to include any type of anchoring device having flights, threads, projections or similar structures that provide increased surface area adapted to resist axial movement of the anchoring device when the anchoring device is embedded in the ground. The term "power auger" is intended to mean an auger having a drive mechanism for rotating the auger.

Figure 4:
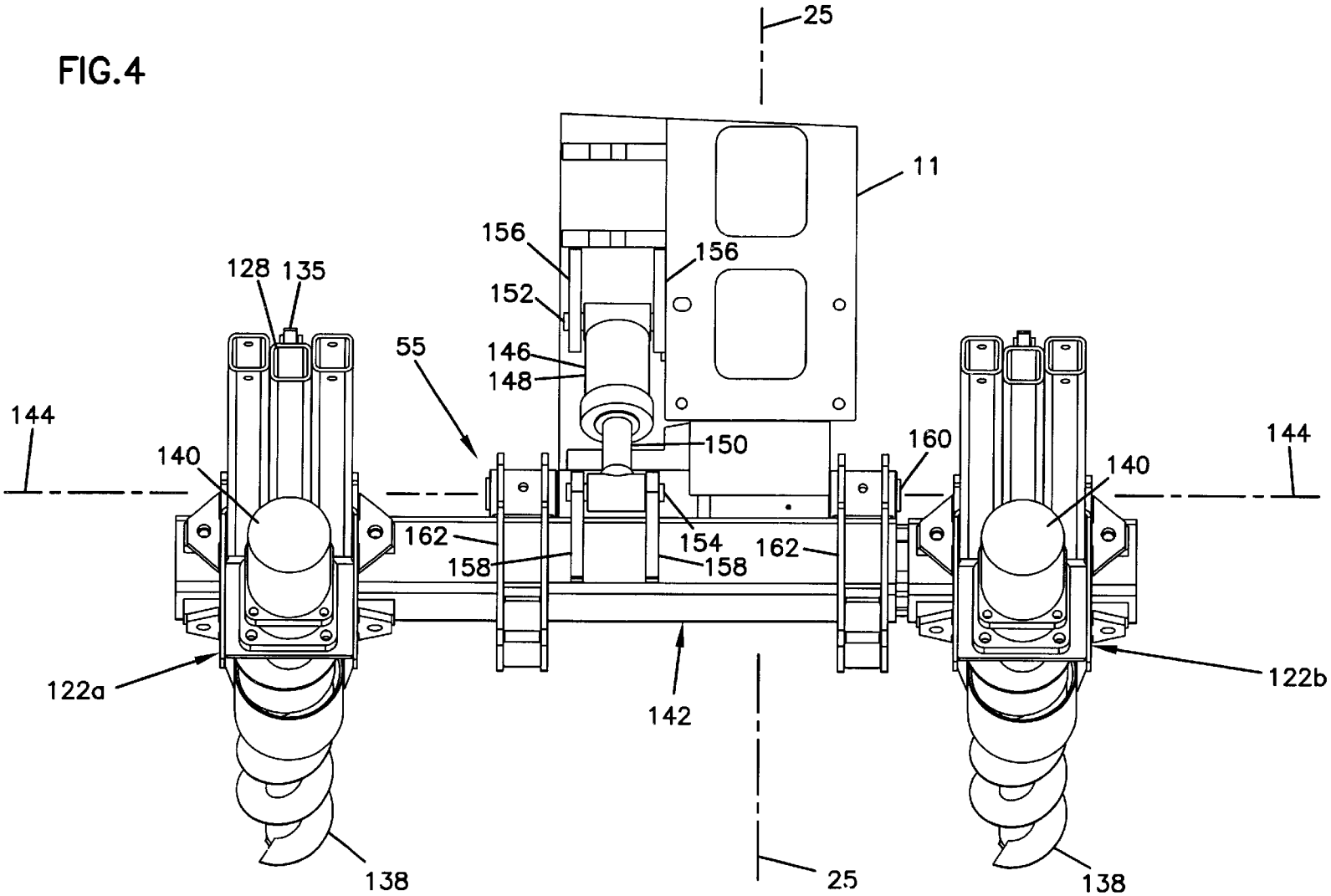
FIG. 4 is a top view of the anchoring system of FIGS. 2 and 3.

As best shown in FIG. 4, the tilt actuator 146 of the anchoring system 120 includes a cylinder 148 and a piston rod 150. The cylinder 148 is pivotally connected to the frame 11 by pivot pin 152, and the piston rod 150 is pivotally connected to the stake-down mount 142 by pivot pin 154. The pivot pin 152 is supported on the frame 11 by pivot mounts 156 that are connected (e.g., welded) to the frame 11. Similarly, the pivot pin 154 is supported on the stake-down mount 142 by pivot mounts 158 that are connected (e.g., welded) to the stake-down mount 142.

Still referring to FIG. 4, the stake-down mount 142 is pivotally connected to the frame 11 by a pivot shaft 160 that extends through the opening 57 of the frame mounting location 55. The ends of the pivot shaft 160 are received within mounts 162 located on opposite sides of the frame 11. The mounts 162 are connected to the stake-down mount 142 by conventional techniques such as welding.

Referring again to FIGS. 2 and 3, the stake-down units 122*a* and 122*b* include platforms 126 on which the drive mechanisms 140 of the power augers 124 are mounted. Each of the platforms 126 is connected to an elongated slide member 128 that is mounted between two parallel guide members 130. Side plates 132 are provided on opposite sides of the platforms 126. Rear portions of the side plates 132 extend along side and behind the guide members 130.

Figure 6:
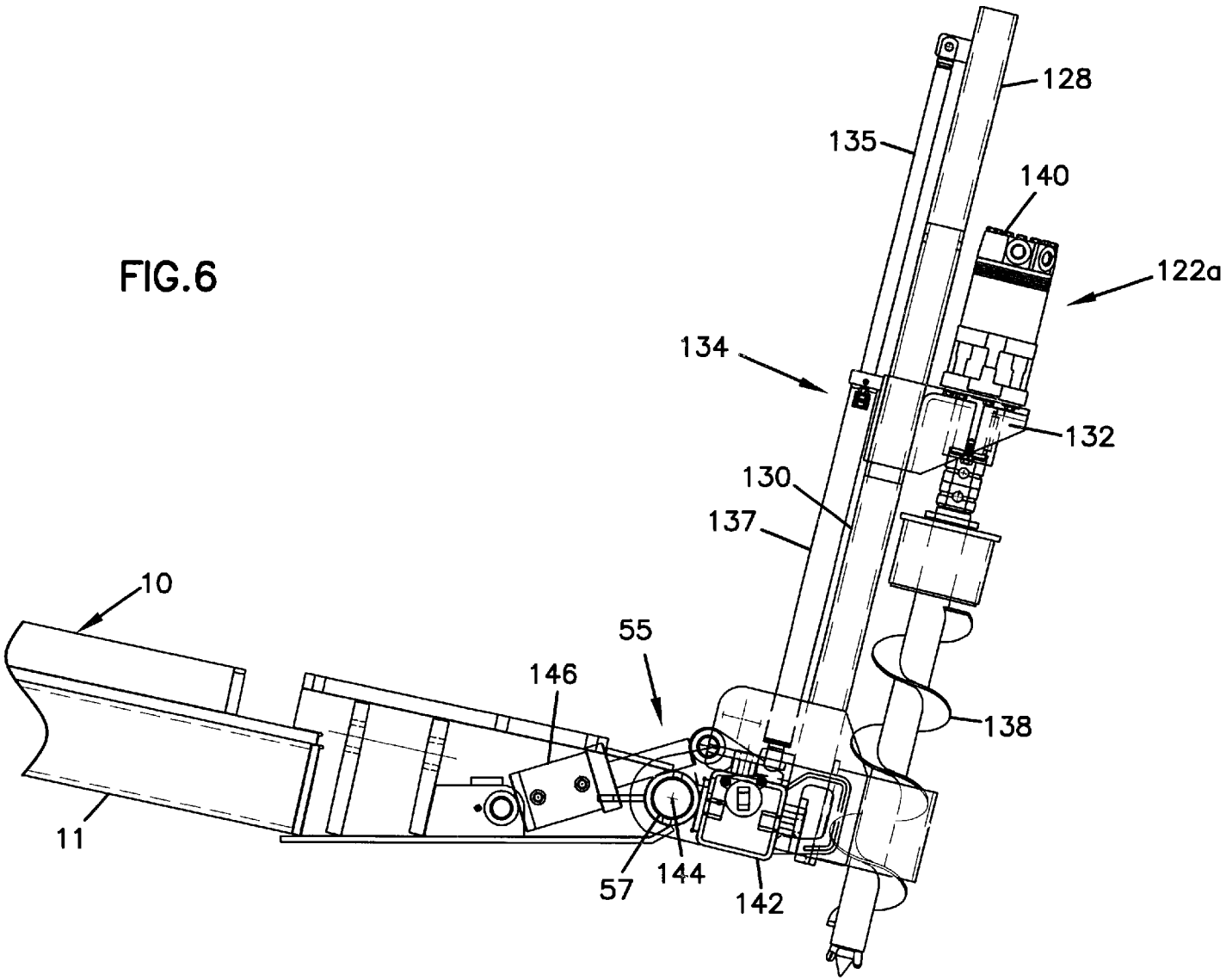
FIG. 6 is a side view of the anchoring system of FIGS. 2 and 3 with the power auger of one of the stake-down units in a raised orientation.

Stake-down actuators 134 (e.g., hydraulic cylinders, pneumatic cylinders, or other type of drive mechanism) are provided for moving each power auger 124 between a lower position (shown in FIGS. 2, 3, 7 and 8) and an upper position (shown in FIG. 6). Referring to FIG. 6, the actuators 134 include hydraulic cylinders having piston rods 135 connected to the elongated slide members 128, and cylinders 137 secured to the stake-down mount 142. As the power augers 124 are moved between the upper and lower positions, the slide members 128 slide along channels defined between the guide members 130, and the side plates 132 ride along the outside the guide members 130.

An advantage of the anchoring system 120 is that the stake-down unit 122*b* can be laterally moved or adjusted relative to the thrust axis 25 of the frame to avoid obstacles (e.g., rocks, tree roots, etc.) in the ground, to accommodate uneven ground conditions, or simply to maximize the spacing between the anchors. For example, the stake-down unit 122*b* is moveable between a laterally retracted position (shown in FIG. 2) and a laterally extended position (shown in FIG. 3).

The lateral movement of the stake-down unit 122*b* is provided by an extension member 164 (e.g., a square tube) that is telescopically mounted within the stake-down mount 142. The to accommodate or receive the extension member 164, the stake-down mount 142 is preferably at least partially hollow. For example, in certain embodiments, the stake-down mount 142 can comprise a length of steel, square tube.

Figure 5:
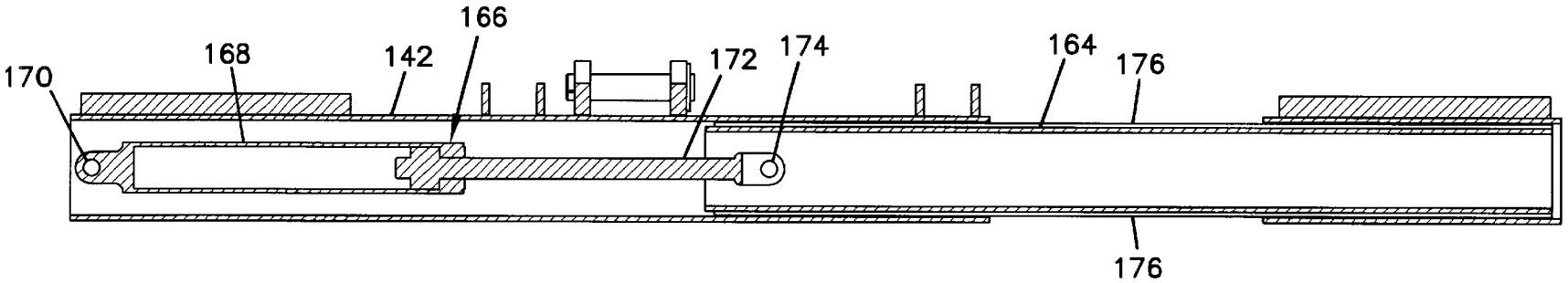
FIG. 5 is a schematic cross-sectional view showing a lateral extension mechanism for extending one of the stake-down units of FIGS. 2 and 3.

A lateral adjustment actuator 166 (e.g., a hydraulic cylinder, a pneumatic cylinder, or other type of drive arrangement) is provided for adjusting the lateral position of the stake-down unit 122*b* relative to the thrust axis 25. In FIG. 3, a portion of the extension member 164 has been broken away such that the lateral position actuator 166 is visible. As best shown in FIG. 5, the lateral position actuator 166 is shown as a hydraulic cylinder mounted within the stake-down mount 142 and the extension member 164. The hydraulic cylinder includes a cylinder portion 168 connected to the stake-down mount 142 at position 170, and a piston rod 172 connected to the extension member 164 at position 174. By extending and retracting the hydraulic cylinder, the extension 164 is extended and retracted relative to the stake-down mount 142. To facilitate sliding between the stake-down mount 142 and the extension member 164, a low friction liner 176 (e.g. ultra high molecular weight plastic) can be used to form an interface between the two components.

In use of the directional drilling machine 10 equipped with the anchoring system 120, the track 22 of the directional drilling machine 10 is first oriented at an oblique angle relative to the ground. The stake-down mount 142 is then pivoted about the tilt axis 144 to a desired stake-down angle. Once the desired stake-down angle has been achieved, the drive mechanisms 140 of the power augers 124 are activated causing the augers 130 to rotate in a forward direction. Concurrently, the stake-down actuators 134 drive the power augers 124 downwardly from the upper position (shown in FIG. 6) to the lower position (shown in FIGS. 2, 3, 7 and 8). As the power augers 124 are driven downwardly, the augers 138 are screwed or embedded into the ground so as to anchor the directional drilling machine 10. Prior to driving the augers into the ground, the position of the stake-down unit 122*b* can be laterally adjusted relative to the thrust axis 25 by extending or retracting the lateral adjustment actuator 166.

To remove the augers 138 from the ground, the drive mechanisms 140 rotate the augers 138 in a reverse direction, while the stake-down actuators 134 move the power augers 124 from the lower position to the upper position. In this manner, the augers 138 are unscrewed from the ground.

It is to be understood that the invention is not limited to the exact details of construction, operation, exact materials or embodiments shown and described, as obvious modifications and equivalence will be apparent to one skilled in the art. Accordingly, the invention is therefore to be limited only by the scope of the appended claims.

We claim:

1. A horizontal directional drilling machine for generating a bore with a drill string, the machine comprising:

a frame defining a thrust axis;

a rotational drive head for rotating the drill string, the rotational drive head being mounted on the frame;

a thrust mechanism for moving the rotational drive head in a first direction along the thrust axis to push the drill string into the ground, and a second direction along the thrust axis to pull the drill string from the ground;

an anchoring arrangement connected to the frame, the anchoring arrangement including:

a) a first stake-down unit that is pivotally moveable about a pivot axis that is generally transversely oriented relative to the thrust axis, the stake-down unit including:

i) a first power auger; and ii) a first stake-down actuator for moving the first power auger toward and away from the ground; and b) a tilt actuator for pivoting the first stake-down unit about the pivot axis.

2. The directional drilling machine of claim 1, further comprising a second stake-down unit pivotally moveable about the pivot axis, and the second stake-down unit including a second power auger and a second stake-down actuator for moving the second power auger toward and away from the ground.

3. The directional drilling machine of claim 2, wherein at least the first stake-down unit is laterally moveable relative to the thrust axis.

4. The directional drilling machine of claim 3, further comprising a lateral adjustment actuator for laterally moving the first stake-down unit relative to the thrust axis.

5. The directional drilling machine of claim 3, wherein the second stake-down unit is laterally fixed relative to the thrust axis.

6. The directional drilling machine of claim 2, wherein the first and second stake-down units are connected to a common stake-down mount that is pivotally connected to the frame at the tilt axis and that is pivoted about the tilt axis by the tilt actuator.

7. The directional drilling machine of claim 6, wherein the first stake-down unit is connected to the stake-down mount by an extension member that is mounted to slide relative to the stake-down mount in a lateral direction with respect to the thrust axis.

8. The directional drilling machine of claims 7, wherein the extension member is telescopically mounted within the stake-down mount.

9. The directional drilling machine of claim 8, further comprising a lateral adjustment actuator at least partially mounted within the stake-down mount for moving the extension member relative to the stake-down mount.

10. The directional drilling machine of claim 1, wherein the first stake-down unit is laterally moveable relative to the thrust axis.

11. The directional drilling machine of claim 10, further comprising a lateral adjustment actuator for laterally moving the first stake-down unit relative to the thrust axis.

12. The directional drilling machine of claim 1, wherein the first stake-down unit is connected to a stake-down mount that is pivotally connected to the frame at the tilt axis and that is pivoted about the tilt axis by the tilt actuator.

13. The directional drilling machine of claim 12, wherein the first stake-down unit is connected to the stake-down mount by an extension member that is mounted to slide relative to the stake-down mount in a lateral direction with respect to the thrust axis.

14. The directional drilling machine of claim 13, wherein the extension member is telescopically mounted within the stake-down mount.

15. The directional drilling machine of claim 14, further comprising a lateral adjustment actuator at least partially mounted within the stake-down mount for moving the extension member relative to the stake-down mount.

16. The directional drilling machine of claim 1, wherein the tilt actuator comprises a hydraulic cylinder.

17. The directional drilling machine of claim 1, wherein the first stake-down actuator comprises a hydraulic cylinder.

18. The directional drilling machine of claim 1, wherein the first power auger includes a hydraulic motor.

19. An anchoring assembly for a directional drilling machine, the anchoring assembly comprising:

a stake-down mount adapted to be pivotally connected to the directional drilling machine;

a first stake-down unit connected to the stake-down mount by a lateral extension member that is mounted to slide relative to the stake-down mount, the first stake-down unit including a first power auger and a first stake-down actuator; and a second stake-down unit connected to the stake-down mount, the second stake-down unit including a second power auger and a second stake-down actuator.

20. The directional drilling machine of claim 19, wherein the extension member is telescopically mounted within the stake-down mount.

21. The directional drilling machine of claim 20, further comprising a lateral adjustment actuator at least partially mounted within the stake-down mount for moving the extension member relative to the stake-down mount.

22. A method for anchoring a horizontal directional drilling machine, the horizontal directional drilling machine including a frame having a thrust axis, the method comprising:

aligning the thrust axis at an oblique angle relative to the ground;

pivoting a power auger of the directional drilling machine about a tilt axis generally transversely aligned relative to the thrust axis; and driving the power auger into the ground.

23. The method of claim 22, further comprising adjusting a lateral position of the power auger relative to the thrust axis.

* * * * *

UNITED STATES PATENT AND TRADEMARK OFFICE

CERTIFICATE OF CORRECTION

PATENT NO. : 6,497,296 B1
DATED : December 24, 2002
INVENTOR(S) : McGriff et al.

It is certified that error appears in the above-identified patent and that said Letters Patent is hereby corrected as shown below:

Column 3,
Line 21, "female end (shown" should read -- female end 20 (shown --

Column 7,
Line 42, "claims" should read -- claim --

Signed and Sealed this

Eighth Day of April, 2003

JAMES E. ROGAN
*Director of the United States Patent and Trademark Office*